US010198995B1

(12) United States Patent
Chen

(10) Patent No.: US 10,198,995 B1
(45) Date of Patent: Feb. 5, 2019

(54) PIXEL DRIVING CIRCUIT AND DRIVING METHOD

(71) Applicant: SHENZHEN CHINA STAR OPTOELECTRONICS SEMICONDUCTOR DISPLAY TECHNOLOGY, CO., LTD., Shenzhen, Guangdong (CN)

(72) Inventor: Xiaolong Chen, Guangdong (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/573,051

(22) PCT Filed: Nov. 2, 2017

(86) PCT No.: PCT/CN2017/109091

§ 371 (c)(1),
(2) Date: Nov. 9, 2017

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0819* (2013.01); *G09G 2310/08* (2013.01); *G09G 2320/0233* (2013.01); *G09G 2320/045* (2013.01)

(58) Field of Classification Search
CPC ..... G09G 3/3258; G09G 3/3266; G09G 2300/0819; G09G 2310/08; G09G 2320/0233; G09G 2320/045
See application file for complete search history.

(56) References Cited

U.S. PATENT DOCUMENTS

2012/0139890 A1* 6/2012 Choi ..... G09G 3/3233 345/212
2015/0339974 A1* 11/2015 Wu ..... G09G 3/3233 345/690
2016/0063921 A1* 3/2016 Tsai ..... G09G 3/3233 345/76
2016/0063922 A1* 3/2016 Tsai ..... G09G 3/3233 345/76
2016/0307502 A1* 10/2016 Nie ..... G09G 3/3233

FOREIGN PATENT DOCUMENTS

CN 104658483 A 5/2015
CN 104867442 A 8/2015

* cited by examiner

*Primary Examiner* — Mihir K Rayan
(74) *Attorney, Agent, or Firm* — Ladas & Parry LLP

(57) ABSTRACT

The pixel driving circuit and the driving method for driving pixels of an AMOLED display are provided. A 6T1C circuit is adopted by the pixel driving circuit and the pixel driving method proposed by the present disclosure so the threshold voltage of the driving tube is effectively compensated and that the current flowing through a light emitting device is not affected by the threshold voltage of the driving tube. The display brightness of the light emitting device is not affected by the ageing of the light emitting device itself, and the display of the panel becomes much more even; in other words, the display effect of the image improves. Besides, the structure of the light emitting device is simplified. In other words, the cost is obviously saved.

12 Claims, 6 Drawing Sheets

PIXEL DRIVING CIRCUIT AND DRIVING METHOD

BACKGROUND

1. Field of the Disclosure

The present disclosure relates to the field of a display technique, and more particularly, to a pixel driving circuit and a driving method.

2. Description of the Related Art

Active matrix organic light emitting diodes (AMOLEDs) are one of the hotspots for research on plat displays nowadays. Compared with liquid-crystal displays (LCDs), the merits of organic light-emitting diodes (OLEDs) are low power consumption, low production cost, automatic luminescence, wide viewing angles, fast response speed, etc. The OLEDs have been gradually substituted for LCD display screens of the related art and wide applied to display devices such as cellphones, personal digital assistants (PDAs), and digital cameras. Especially, pixel driving belongs to a core technique, which is worth the effort.

The AMOLED of the related art is usually a 2T1C driving circuit. Please refer to FIG. 1. The 2T1C driving circuit includes two thin-film transistors (TFTs) and a capacitor. T1 is a driving tube of the driving circuit. T2 is a switch tube. The switch tube T2 is turned on with a scanning line Gate. A data voltage Date charges and discharges a storage capacitor Cst. The switch tube T2 is turned off during an illumination period. The driving tube T1 keeps turned on with a voltage stored in the capacitor. A conductive current flowing through the OLED makes the OLED emit light. The current flowing through the OLED needs to keep stable to stabilize display. However, the TFT is driven with poorly uniform threshold voltage and shifts occur to the TFT due to the limit of the craftsmanship. Different driving currents are produced though the same grayscale voltage is input. Further, inconsistence of the driven currents causes the light emitting device to be unstable in operation. In addition, the ageing of the light emitting device forces the voltage to increase, which results in lousy uniform of the brightness of a panel and poor luminous efficacy.

Due to the above-mentioned defects, the 2T1C driving circuit of the related art has been improved actually. A new TFT or a new signal is added to the 2T1C driving circuit to weaken or even diminish the influence of the threshold voltage shift. However, a lot of TFTs and voltage control lines and additional power are required for the improved circuit, and the control timing is relatively more sophisticated as well, which costs a lot of money.

Therefore, it is necessary to provide a pixel driving circuit and a pixel driving method to solve the problem of the related art.

SUMMARY

An object of the present disclosure is to provide a pixel driving circuit and a pixel driving method so that a driving circuit with a sophisticated structure of the related art can be replaced and that the influence of a threshold voltage of a driving tube on the driving current vanishes.

The present also proposes a pixel driving circuit comprising: a first thin-film transistor (TFT), comprising a gate electrically connected to a first node, a source electrically connected to a second node, and a drain electrically connected to a third node; a second TFT, comprising a gate receiving the first scanning signal, a source grounded, and a drain electrically connected to a fourth node; a third TFT, comprising a gate receiving a second scanning signal, a source electrically receiving a data signal, and a drain electrically connected to the second node; a fourth TFT, comprising a gate receiving the first scanning signal, a source electrically connected to the third node, and a drain electrically connected to the first node; a fifth TFT, comprising a gate receiving a third scanning signal, a source receiving a power positive voltage, and a drain electrically connected to the third node; a sixth TFT, comprising a gate receiving a fourth scanning signal, a source electrically connected to the second node, and a drain electrically connected to the fourth node; a capacitor, electrically connected between the first node and the fourth node; an organic light-emitting diode (OLED), comprising an anode electrically connected to the fourth node and a cathode receiving a power negative voltage. The first scanning signal, the second scanning signal, the third scanning signal, and the fourth scanning signal are all provided by an external timing controller. The first scanning signal, the second scanning signal, the third scanning signal, and the fourth scanning signal are applied to a voltage-level initial phase, a voltage-level storage phase, and an illumination display phase.

According to the present disclosure, the first TFT, the second TFT, the third TFT, the fourth TFT, the fifth TFT, and the sixth TFT are all low temperature poly-silicon (LTPS) TFTs, oxide semiconductor TFTs, or amorphous silicon (a-Si) TFTs.

According to the present disclosure, the first TFT, the second TFT, the third TFT, the fourth TFT, the fifth TFT, and the sixth TFT are all N-type TFTs. At the voltage-level initial phase, the first scanning signal provides a high voltage level; the second scanning signal provides a high voltage level; the third scanning signal provides a high voltage level; the fourth scanning signal provides a low voltage level. During the voltage-level storage phase, the first scanning signal provides a high voltage level; the second scanning signal provides a high voltage level; the third scanning signal provides a low voltage level; the fourth scanning signal provides a low voltage level. During the illumination display phase, the first scanning signal provides a low voltage level; the second scanning signal provides a low voltage level; the third scanning signal provides a high voltage level; the fourth scanning signal provides a high voltage level.

The present also proposes a pixel driving circuit comprising: a first thin-film transistor (TFT), comprising a gate electrically connected to a first node, a source electrically connected to a second node, and a drain electrically connected to a third node; a second TFT, comprising a gate receiving the first scanning signal, a source grounded, and a drain electrically connected to a fourth node; a third TFT, comprising a gate receiving a second scanning signal, a source electrically receiving a data signal, and a drain electrically connected to the second node; a fourth TFT, comprising a gate receiving the first scanning signal, a source electrically connected to the third node, and a drain electrically connected to the first node; a fifth TFT, comprising a gate receiving a third scanning signal, a source receiving a power positive voltage, and a drain electrically connected to the third node; a sixth TFT, comprising a gate receiving a fourth scanning signal, a source electrically connected to the second node, and a drain electrically connected to the fourth node; a capacitor, electrically connected between the first node and the fourth node; an organic light-emitting diode (OLED), comprising an anode electrically connected to the fourth node and a cathode receiving a power negative voltage.

According to the present disclosure, the first TFT, the second TFT, the third TFT, the fourth TFT, the fifth TFT, and the sixth TFT are all low temperature poly-silicon (LTPS) TFTs, oxide semiconductor TFTs, or amorphous silicon (a-Si) TFTs.

According to the present disclosure, the first scanning signal, the second scanning signal, the third scanning signal, and the fourth scanning signal are all provided by an external timing controller.

According to the present disclosure, the first scanning signal, the second scanning signal, the third scanning signal, and the fourth scanning signal are applied to a voltage-level initial phase, a voltage-level storage phase, and an illumination display phase.

According to the present disclosure, the first TFT, the second TFT, the third TFT, the fourth TFT, the fifth TFT, and the sixth TFT are all N-type TFTs. At the voltage-level initial phase, the first scanning signal provides a high voltage level; the second scanning signal provides a high voltage level; the third scanning signal provides a high voltage level; the fourth scanning signal provides a low voltage level. During the voltage-level storage phase, the first scanning signal provides a high voltage level; the second scanning signal provides a high voltage level; the third scanning signal provides a low voltage level; the fourth scanning signal provides a low voltage level. During the illumination display phase, the first scanning signal provides a low voltage level; the second scanning signal provides a low voltage level; the third scanning signal provides a high voltage level; the fourth scanning signal provides a high voltage level.

The present also proposes a driving method for driving pixels comprising: step 1: providing a pixel driving circuit comprising: a first thin-film transistor (TFT), comprising a gate electrically connected to a first node, a source electrically connected to a second node, and a drain electrically connected to a third node; a second TFT, comprising a gate receiving the first scanning signal, a source grounded, and a drain electrically connected to a fourth node; a third TFT, comprising a gate receiving a second scanning signal, a source electrically receiving a data signal, and a drain electrically connected to the second node; a fourth TFT, comprising a gate receiving the first scanning signal, a source electrically connected to the third node, and a drain electrically connected to the first node; a fifth TFT, comprising a gate receiving a third scanning signal, a source receiving a power positive voltage, and a drain electrically connected to the third node; a sixth TFT, comprising a gate receiving a fourth scanning signal, a source electrically connected to the second node, and a drain electrically connected to the fourth node; a capacitor, electrically connected between the first node and the fourth node; an organic light-emitting diode (OLED), comprising an anode electrically connected to the fourth node and a cathode receiving a power negative voltage; step 2: during a voltage-level initial phase, controlling a second thin-film transistor (TFT) and a fourth TFT to turn on with a first scanning signal; controlling a third TFT to turn off with a second scanning signal; controlling a fifth TFT to turn on with a third scanning signal; controlling a sixth TFT to turn off with a fourth scanning signal; writing a power positive voltage to a first node and storing the power positive voltage to a capacitor, writing a ground voltage to a fourth node to prevent an organic light-emitting diode (OLED) from emitting light; step 3: during a voltage-level storage phase, controlling the second TFT and the fourth TFT to turn on with the first scanning signal; controlling the third TFT to turn on with the second scanning signal; controlling the fifth TFT to turn off with the third scanning signal; controlling the sixth TFT to turn off with the fourth scanning signal; providing a display data voltage level with a data signal; writing the display data voltage level to a second node; writing a ground voltage to the fourth node; keeping a voltage imposed on the first node the same as the sum of a voltage imposed on the second node and a threshold voltage of the first TFT with discharge of the capacitor, storing the voltage imposed on the first node to the capacitor to prevent the OLED from emitting the light; and step 4: during an illumination display phase, controlling the second TFT and the fourth TFT to turn off with the first scanning signal; controlling the third TFT to turn off with the second scanning signal; controlling the fifth TFT to turn on with the third scanning signal; controlling the sixth TFT to turn on with the fourth scanning signal; keeping the voltage imposed on the first node the same as the sum of the display data voltage level and the threshold voltage of the first TFT under the function of storage of the capacitor, making a voltage level of the second node consistent with a voltage level of the fourth node; turning the first TFT on; making the OLED emit light; making a current flowing through the OLED irrelevant to the threshold voltage imposed on the first TFT.

According to the present disclosure, the first TFT, the second TFT, the third TFT, the fourth TFT, the fifth TFT, and the sixth TFT are all low temperature poly-silicon (LTPS) TFTs, oxide semiconductor TFTs, or amorphous silicon (a-Si) TFTs.

According to the present disclosure, the first scanning signal, the second scanning signal, the third scanning signal, and the fourth scanning signal are all provided by an external timing controller.

According to the present disclosure, the first TFT, the second TFT, the third TFT, the fourth TFT, the fifth TFT, and the sixth TFT are all N-type TFTs. At the voltage-level initial phase, the first scanning signal provides a high voltage level; the second scanning signal provides a high voltage level; the third scanning signal provides a high voltage level; the fourth scanning signal provides a low voltage level. At the voltage-level storage phase, the first scanning signal provides a high voltage level; the second scanning signal provides a high voltage level; the third scanning signal provides a low voltage level; the fourth scanning signal provides a low voltage level. At the illumination display phase, the first scanning signal provides a low voltage level; the second scanning signal provides a low voltage level; the third scanning signal provides a high voltage level; the fourth scanning signal provides a high voltage level.

In addition to the use of simple driving timing, a 6T1C circuit is adopted by the pixel driving circuit and the pixel driving method proposed by the present disclosure so the threshold voltage of the driving tube is effectively compensated and that the current flowing through a light emitting device is not affected by the threshold voltage of the driving tube. The display brightness of the light emitting device is not affected by the ageing of the light emitting device itself, and the display of the panel becomes much more even; in other words, the display effect of the image improves. Besides, the structure of the light emitting device is simplified; in other words, the cost is obviously saved.

These and other features, aspects and advantages of the present disclosure will become understood with reference to the following description, appended claims and accompanying figures.

BRIEF DESCRIPTION OF THE DRAWINGS

The invention is described below in detail with reference to the accompanying drawings, wherein like reference numerals are used to identify like elements illustrated in one or more of the figures thereof, and in which exemplary embodiments of the invention are shown.

DETAILED DESCRIPTION OF THE EMBODIMENTS

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

Figure 1:
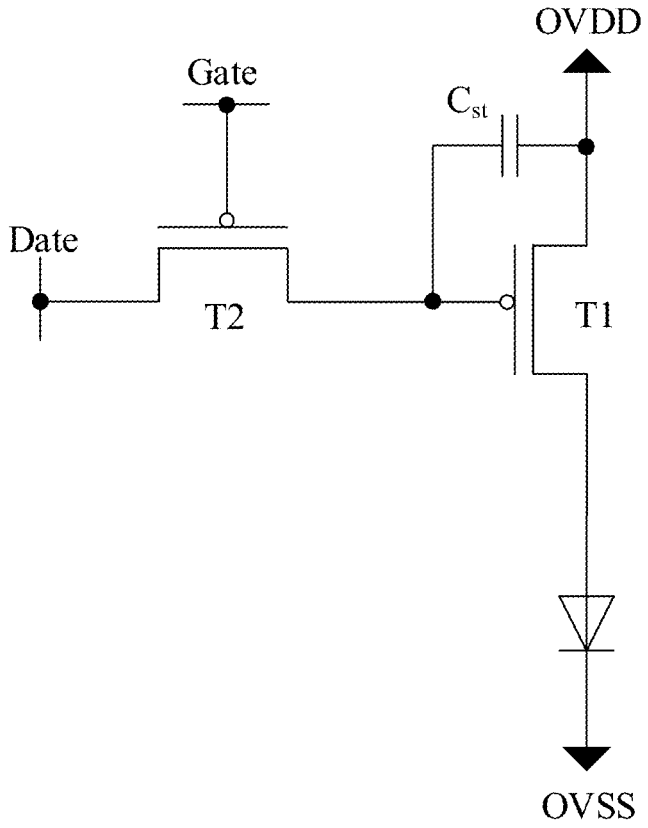
Fig. 1 (Related art)
FIG. 1 illustrates a circuit diagram of a conventional pixel driving circuit having two transistors and a capacitor.
Figure 2:
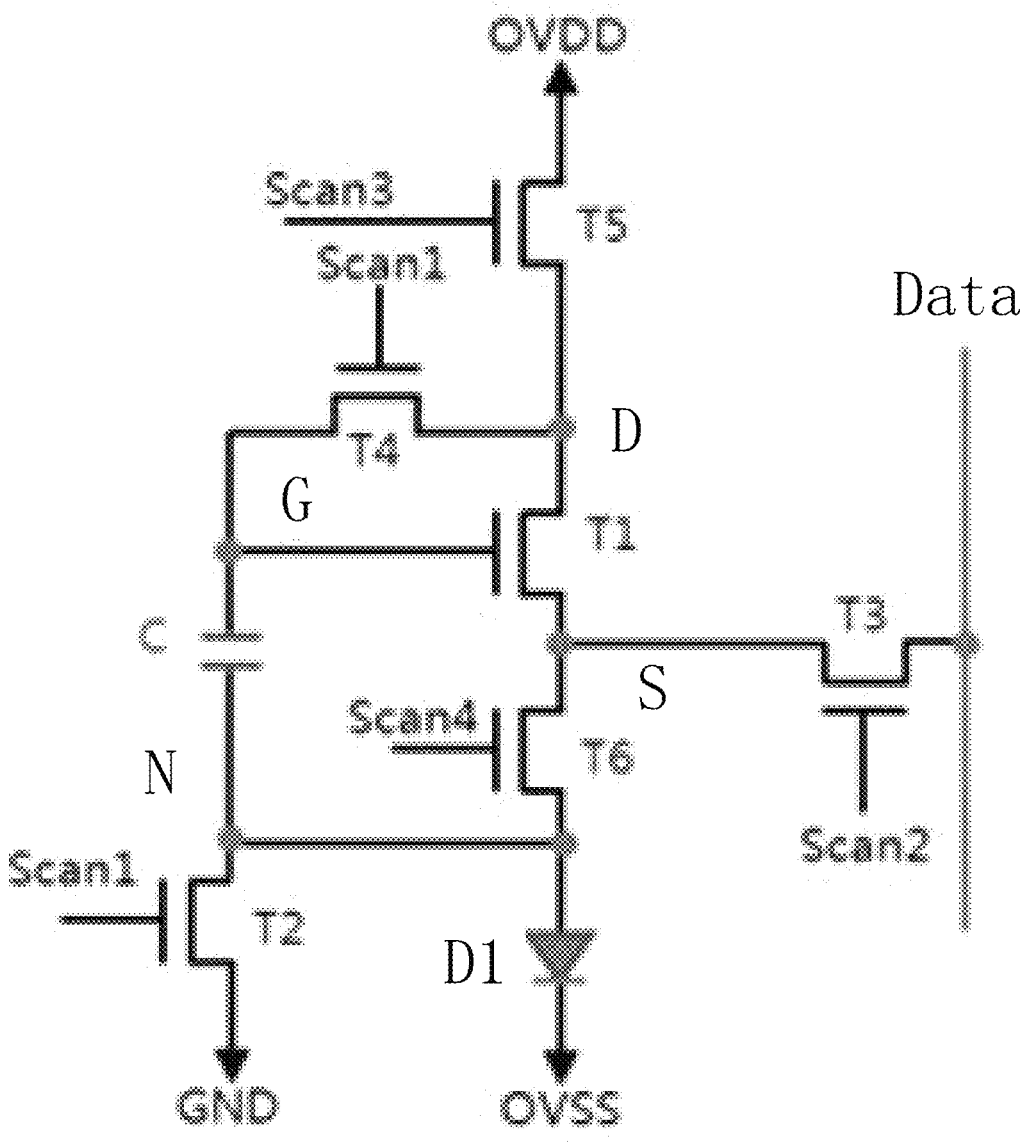
FIG. 2 illustrates a schematic diagram of a pixel driving circuit according to an embodiment of the present disclosure.

FIG. 2 illustrates a schematic diagram of a pixel driving circuit according to an embodiment of the present disclosure. The pixel driving circuit is a structure of 6T1C and includes a first thin-film transistor (TFT) T1, a second TFT T2, a third TFT T3, a fourth TFT T4, a fifth TFT T5, a sixth TFT T6, a capacitor C, and an organic light-emitting diode (OLED) D1.

A gate of the first TFT T1 is electrically connected to a first node G. A source of the first TFT T1 is electrically connected to a second node S. A drain of the first TFT T1 is electrically connected to a third node D. A gate of the second TFT T2 receives a first scanning signal Scan1. A source of the second TFT T2 is grounded. A drain of the second TFT T2 is electrically connected to a fourth node N. A gate of the third TFT T3 receives a second scanning signal Scan2. A source of the third TFT T3 receives a data signal Data. A drain of the third TFT T3 is electrically connected to the second node S. A gate of the fourth TFT T4 receives the first scanning signal Scan1. A source of the fourth TFT T4 is electrically connected to the third node D. A drain of the fourth TFT T4 is electrically connected to the first node G. A gate of the fifth TFT T5 receives a third scanning signal Scan3. A source of the fifth TFT T5 receives a power positive voltage OVDD. A drain of the fifth TFT T5 is electrically connected to the third node D. A gate of the sixth TFT T6 receives a fourth scanning signal Scan4. A source of the sixth TFT T6 is electrically connected to the second node S. A drain of the sixth TFT T6 is electrically connected to the fourth node N. One terminal of the capacitor C is electrically connected to the first node G, and the other terminal of the capacitor C is electrically connected to the fourth node N. An anode of the OLED D1 is electrically connected to the fourth node N, and a cathode of the OLED D1 receives a power negative voltage OVSS.

The first scanning signal Scan1 controls the second TFT T2 and the fourth TFT T4 to turn on and off. The second scanning signal Scan2 controls the third TFT T3 to turn on and off. The third scanning signal Scan3 controls the fifth TFT T5 to turn on and off. The fourth scanning signal Scan4 controls the sixth TFT T6 to turn on and off. A data signal Data is configured to control luminous intensity of the OLED D1. The capacitor C is a storage capacitor. Further, the OLED D1 is compensated with the short circuit of the TFT T1 for the threshold voltage by turning the fourth TFT T4 on.

Specifically, the first TFT T1, the second TFT T2, the third TFT T3, the fourth TFT T4, the fifth TFT T5, and the sixth TFT T6 are all low temperature poly-silicon (LTPS) TFTs, oxide semiconductor TFTs, or amorphous silicon (a-Si) TFTs. Six thin-film transistors (TFTs) as mentioned above are all N-type TFTs to facilitate the establishment of a circuit in another embodiment.

Specifically, the first scanning signal Scan1, the second scanning signal Scan2, the third scanning signal Scan3, and the fourth scanning signal Scan4 are all provided by an external timing controller, as FIG. 2 illustrates.

Figure 3:
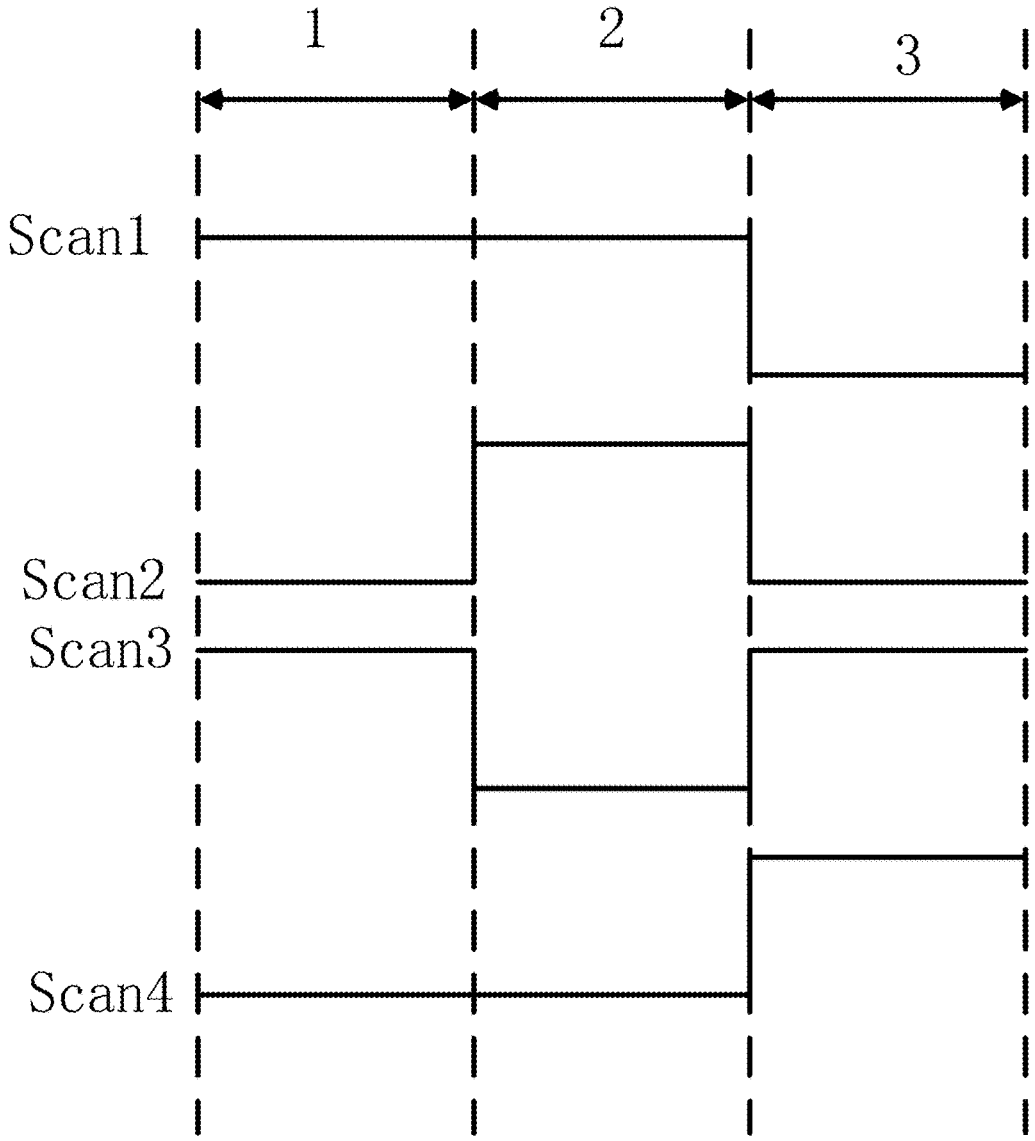
FIG. 3 illustrates a timing diagram of a pixel driving circuit according to an embodiment of the present disclosure.

FIG. 3 is a timing diagram of controlling signals applied to the pixel driving circuit of FIG. 2 according to another embodiment of the present disclosure. Voltage levels of a first scanning signal Scan1, a second scanning signal Scan2, a third scanning signal Scan3, and a fourth scanning signal Scan4 are shown in a voltage-level initial phase 1, a voltage-level storage phase 2, and an illumination display phase 3.

Figure 4:
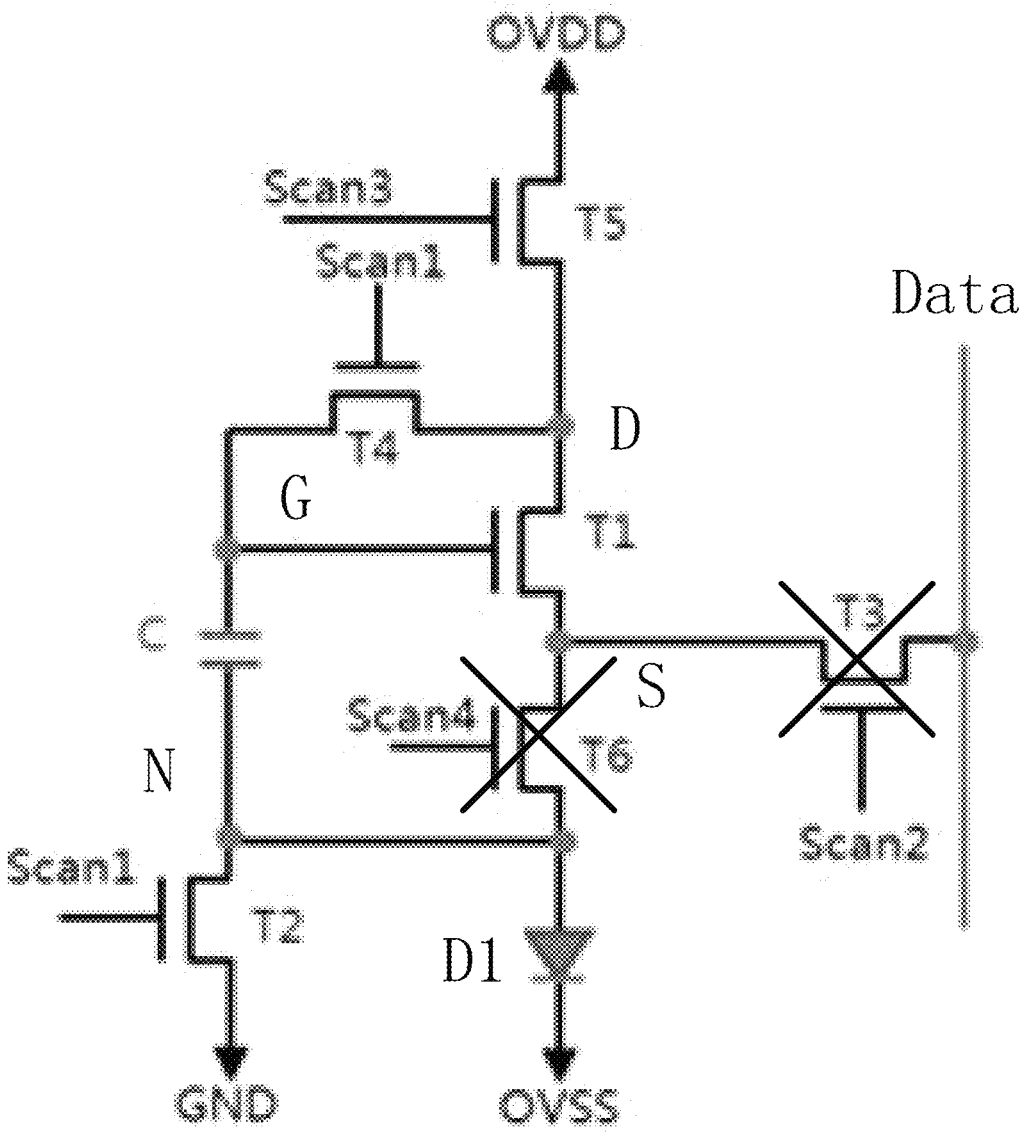
FIG. 4 is a diagram illustrating the operation of the pixel driving circuit corresponding to step 2 of the driving method.
Figure 5:
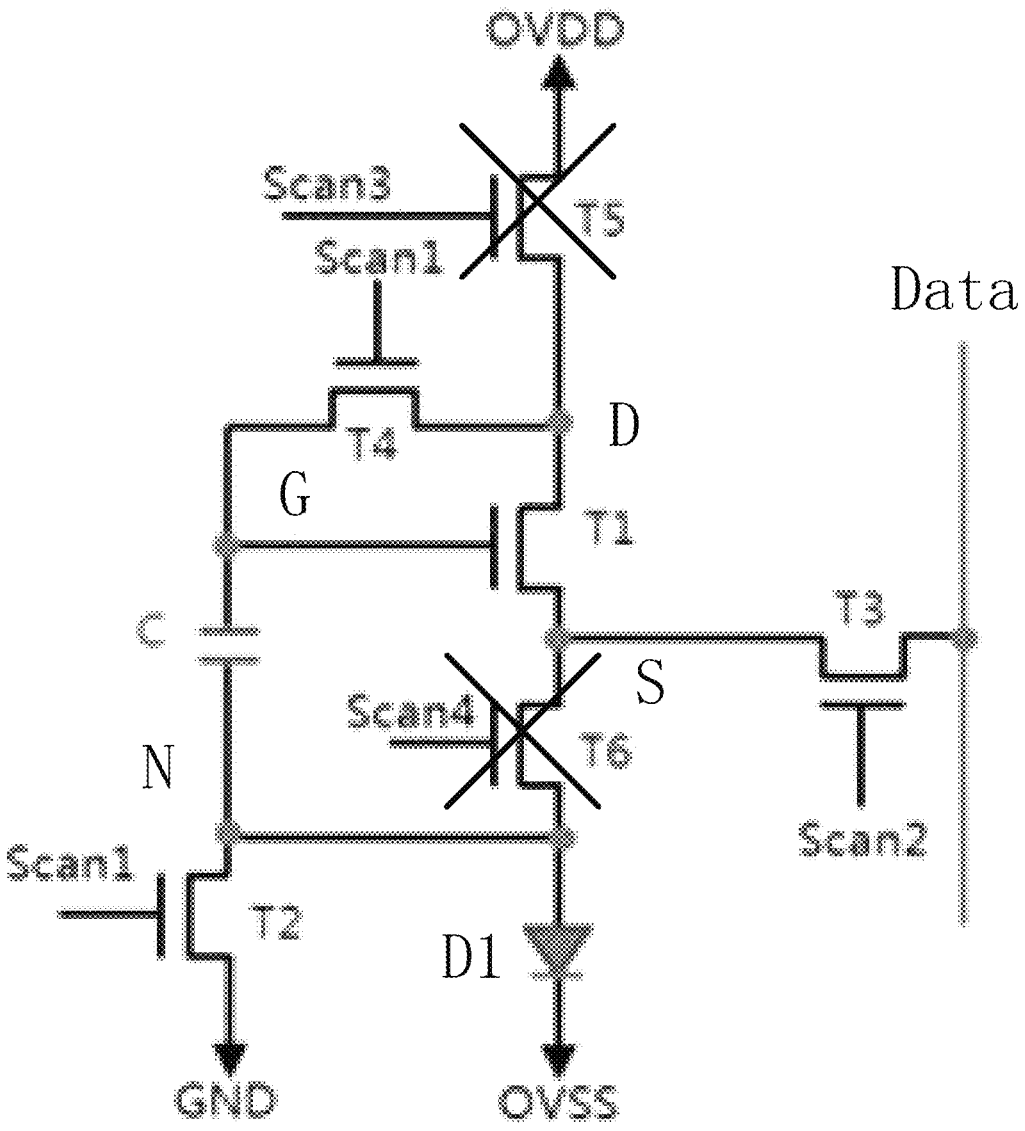
FIG. 5 is a diagram illustrating the operation of the pixel driving circuit corresponding to step 3 of the driving method.
Figure 6:
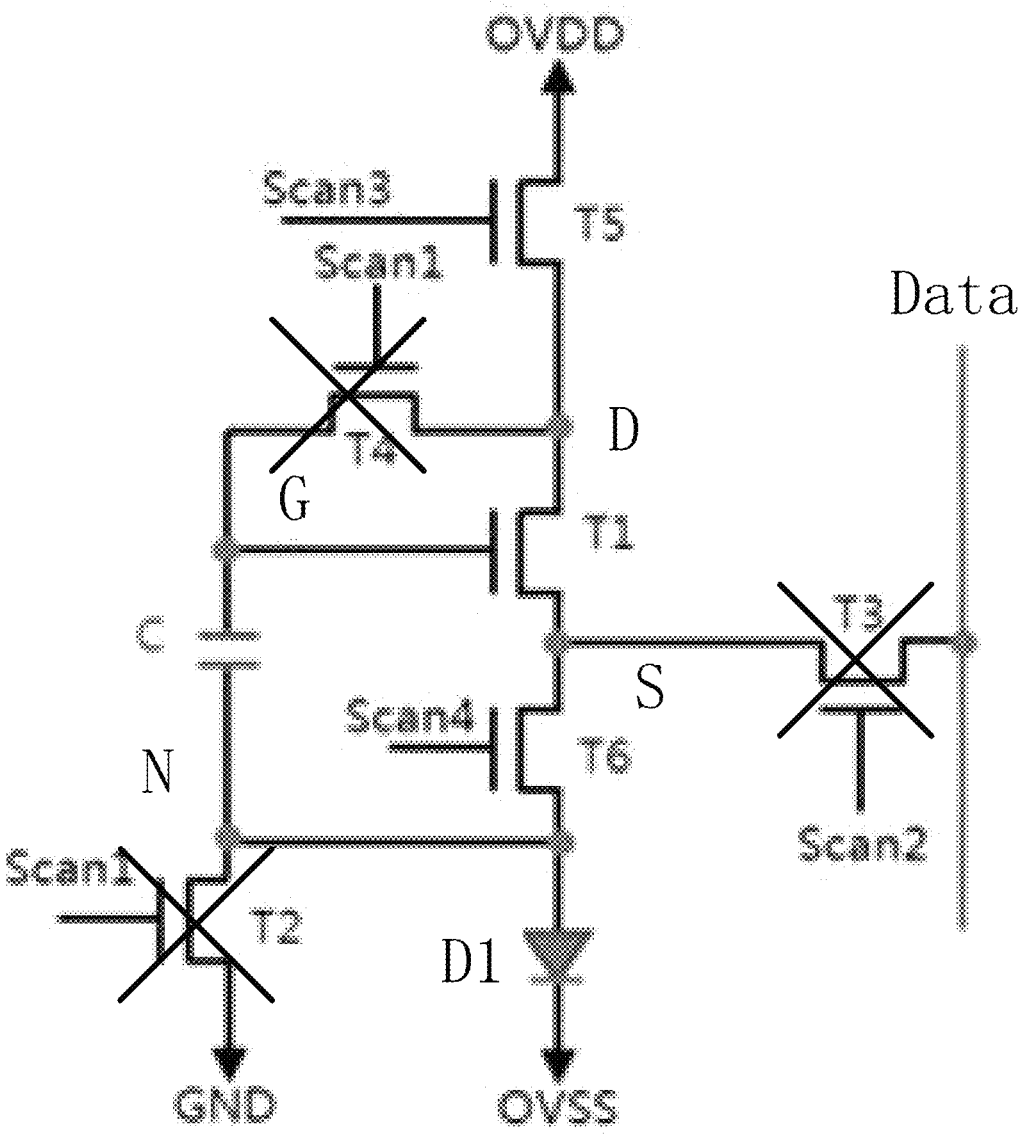
FIG. 6 is a diagram illustrating the operation of the pixel driving circuit corresponding to step 4 of the driving method.

Please refer to FIG. 4 to FIG. 6 as well as FIG. 2 and FIG. 3. The workflow of the pixel driving circuit proposed by the present disclosure is as follows.

Please refer to FIG. 3 and FIG. 4. The second TFT T2, the fourth TFT T4, and the fifth TFT T5 are controlled to be turned on at the voltage-level initial phase 1 because the first scanning signal Scan1 and the third scanning signal Scan3 provide high voltage levels. The third TFT T3 and the sixth TFT T6 are controlled to be turned off at the voltage-level initial phase 1 because the second scanning signal Scan2 and the fourth scanning signal Scan4 provide low voltage levels. The power positive voltage OVDD is written to the first node G (i.e., the gate of the first TFT T1) through the fifth TFT T5 and the fourth TFT T4, which have been turned on, and stored in the capacitor C. A ground voltage is written to the fourth node N so the OLED D1 does not emit light.

Please refer to FIG. 3 and FIG. 5. At the voltage-level storage phase 2, the second TFT T2, the third TFT T3, and the fourth TFT T4 are controlled to be turned on; the third scanning signal Scan3 and the fourth scanning signal Scan4 are at a low voltage level; the fifth TFT T5 and the sixth TFT T6 are controlled to be turned off because the first scanning signal Scan1 and the second scanning signal Scan2 provide high voltage levels. The data signal provides a display data voltage level Vdata. Because the third TFT T3 is turned on, the display data voltage level Vdata is written to the second node S (i.e., the source of the first TFT T1). When the fourth TFT T4 turns on, the gate and the drain of the first TFT T1 are short-circuited. The voltage applied on the first node G (i.e., the gate of the first TFT T1) continuously discharges through the source of the first TFT T1 until the voltage level of the first node G matches the sum of the display data voltage level Vdata and the threshold voltage Vth of the first TFT T1; that is, Vg=Vs+Vth=Vdata+Vth stands where Vg indicates a voltage imposed on the gate of the first TFT T1; Vs indicates a voltage imposed on the source of the first TFT T1; Vth indicates the threshold voltage of the first TFT T1. At this time, the voltage imposed on the gate of the first TFT T1 is stored in the capacitor C. The OLED D1 does not emit light.

Please refer to FIG. 3 and FIG. 6. At the illumination display phase 3, the fifth TFT T5 and the sixth TFT T6 are controlled to be turned on because the third scanning signal Scan3 and the fourth scanning signal Scan4 provide high voltage levels. The second TFT T2, the third TFT T3, and the fourth TFT T4 are controlled to be turned off because the first scanning signal Scan1 and the second scanning signal Scan2 provide low voltage levels. The voltage imposed on the first node G (i.e., the gate of the first TFT T1) keeps the same as the sum of the display data voltage level Vdata and the threshold voltage Vth of the first TFT T1 under the function of storage of the capacitor C. A voltage level of the fourth node N is written to the second node S (i.e., the source of the first TFT T1) through the sixth TFT T6, which have been turned on. In other words, a voltage level of the second node S is consistent with the voltage level of the fourth node N. At this time, Vs=Vn stands; that is, Vgs=Vgn=Vg−Vn=Vdata+Vth stands. The first TFT T1 is turned on, and the OLED D1 emits light.

Further, it is known that the current flowing through the OLED D1 satisfies a formula as follows.

$$I_{D1}=K(V_{gs}-V_{th})^2 \quad (1)$$

$I_{D1}$ indicates the current flowing through the OLED D1; the constant K indicates an intrinsic conduction factor; $V_{gs}$ indicates a voltage difference between the gate of the first TFT T1 and the source of the first TFT T1.

$$Vgs=Vgn=Vg-Vn=V\text{data}+Vth \quad (2)$$

The equation (2) is substituted into the equation (1).

$$I_{D1}=K(V_{gs}-V_{th})^2$$

=K (Vdata+Vth−Vth)2

=K (Vdata)2

Therefore, the current $I_{D1}$ flowing through the OLED D1 is irrelevant to the threshold voltage $V_{th}$ imposed on the first TFT T1 while the current $I_{D1}$ is simply relevant to a data signal voltage $V_{data}$ so the threshold shift of the driven TFT is compensated, thereby solving the problem that the current flows through the LED may be unstable due to the threshold voltage shift of the driven TFT. Besides, the display brightness of the light emitting device is not affected by the ageing of the light emitting device itself, thereby making the display of the panel much more even.

Please refer to FIG. 4 through FIG. 6 in conjunction to FIG. 2 and FIG. 3. The present disclosure proposes a driving method for driving pixels in an AMOLED display. The driving method includes a block 1, a block 2, a block 3 and a block 4.

At the block 1, a pixel driving circuit is provided.

The pixel driving circuit includes a first thin-film transistor (TFT) T1, a second TFT T2, a third TFT T3, a fourth TFT T4, a fifth TFT T5, a sixth TFT T6, a capacitor C, and an organic light-emitting diode (OLED) D1.

A gate of the first TFT T1 is electrically connected to a first node G. A source of the first TFT T1 is electrically connected to a second node S. A drain of the first TFT T1 is electrically connected to a third node D. A gate of the second TFT T2 receives a first scanning signal Scan1. A source of the second TFT T2 is grounded. A drain of the second TFT T2 is electrically connected to a fourth node N. A gate of the third TFT T3 receives a second scanning signal Scan2. A source of the third TFT T3 receives a data signal Data. A drain of the third TFT T3 is electrically connected to the second node S. A gate of the fourth TFT T4 receives the first scanning signal Scan1. A source of the fourth TFT T4 is electrically connected to the third node D. A drain of the fourth TFT T4 is electrically connected to the first node G A gate of the fifth TFT T5 receives a third scanning signal Scan3. A source of the fifth TFT T5 receives a power positive voltage OVDD. A drain of the fifth TFT T5 is electrically connected to the third node D. A gate of the sixth TFT T6 receives a fourth scanning signal Scan4. A source of the sixth TFT T6 is electrically connected to the second node S. A drain of the sixth TFT T6 is electrically connected to the fourth node N. One terminal of the capacitor C is electrically connected to the first node G, and the other terminal of the capacitor C is electrically connected to the fourth node N. An anode of the OLED D1 is electrically connected to the fourth node N, and a cathode of the OLED D1 receives a power negative voltage OVSS.

The first scanning signal Scan1 controls the second TFT T2 and the fourth TFT T4 to turn on and off. The second scanning signal Scan2 controls the third TFT T3 to turn on and off. The third scanning signal Scan3 controls the fifth TFT T5 to turn on and off. The fourth scanning signal Scan4 controls the sixth TFT T6 to turn on and off. A data signal Data is configured to control luminous intensity of the OLED D1. The capacitor C is a storage capacitor. Further, the OLED D1 is compensated with the short circuit of the TFT T1 for the threshold voltage by turning the fourth TFT T4 on.

Specifically, the first TFT T1, the second TFT T2, the third TFT T3, the fourth TFT T4, the fifth TFT T5, and the sixth TFT T6 are all low temperature poly-silicon (LTPS) TFTs, oxide semiconductor TFTs, or amorphous silicon (a-Si) TFTs. Six thin-film transistors (TFTs) as mentioned above are all N-type TFTs to facilitate the establishment of a circuit in another embodiment.

Specifically, the first scanning signal Scan1, the second scanning signal Scan2, the third scanning signal Scan3, and the fourth scanning signal Scan4 are all provided by an external timing controller, as FIG. 2 illustrates.

FIG. 3 is a timing diagram of controlling signals applied to the pixel driving circuit of FIG. 2 according to another embodiment of the present disclosure. Voltage levels of a first scanning signal Scan1, a second scanning signal Scan2, a third scanning signal Scan3, and a fourth scanning signal Scan4 are shown in a voltage-level initial phase 1, a voltage-level storage phase 2, and an illumination display phase 3.

At the block 2, a voltage-level initial phase 1 is performed.

Please refer to FIG. 3 and FIG. 4. The second TFT T2, the fourth TFT T4, and the fifth TFT T5 are controlled to be turned on at the voltage-level initial phase 1 because the first scanning signal Scan1 and the third scanning signal Scan3 provide high voltage levels. The third TFT T3 and the sixth TFT T6 are controlled to be turned off at the voltage-level initial phase 1 because the second scanning signal Scan2 and the fourth scanning signal Scan4 provide low voltage levels. The power positive voltage OVDD is written to the first node G (i.e., the gate of the first TFT T1) through the fifth TFT T5 and the fourth TFT T4, which have been turned on, and stored in the capacitor C. A ground voltage is written to the fourth node N so the OLED D1 does not emit light.

At the block 3, a voltage-level storage phase 2 is performed.

Please refer to FIG. 3 and FIG. 5. At the voltage-level storage phase 2, the second TFT T2, the third TFT T3, and the fourth TFT T4 are controlled to be turned on; the third scanning signal Scan3 and the fourth scanning signal Scan4 are at a low voltage level; the fifth TFT T5 and the sixth TFT T6 are controlled to be turned off because the first scanning signal Scan1 and the second scanning signal Scan2 provide high voltage levels. The data signal provides a display data voltage level Vdata. Because the third TFT T3 is turned on, the display data voltage level Vdata is written to the second node S (i.e., the source of the first TFT T1). When the fourth TFT T4 turns on, the gate and the drain of the first TFT T1 are short-circuited. The voltage applied on the first node G (i.e., the gate of the first TFT T1) continuously discharges through the source of the first TFT T1 until the voltage level of the first node G matches the sum of the display data voltage level Vdata and the threshold voltage Vth of the first TFT T1; that is, Vg=Vs+Vth=Vdata+Vth stands where Vg indicates a voltage imposed on the gate of the first TFT T1; Vs indicates a voltage imposed on the source of the first TFT T1; Vth indicates the threshold voltage of the first TFT T1. At this time, the voltage imposed on the gate of the first TFT T1 is stored in the capacitor C. The OLED D1 does not emit light.

At the block 4, an illumination display phase 3 is performed.

Please refer to FIG. 3 and FIG. 6. At the illumination display phase 3, the fifth TFT T5 and the sixth TFT T6 are controlled to be turned on because the third scanning signal Scan3 and the fourth scanning signal Scan4 provide high voltage levels. The second TFT T2, the third TFT T3, and the fourth TFT T4 are controlled to be turned off because the first scanning signal Scan1 and the second scanning signal Scan2 provide low voltage levels. The voltage imposed on the first node G (i.e., the gate of the first TFT T1) keeps the same as the sum of the display data voltage level Vdata and the threshold voltage Vth of the first TFT T1 under the function of storage of the capacitor C. A voltage level of the fourth node N is written to the second node S (i.e., the source of the first TFT T1) through the sixth TFT T6, which have been turned on. In other words, a voltage level of the second node S is consistent with the voltage level of the fourth node N. At this time, Vs=Vn stands; that is, Vgs=Vgn=Vg−Vn=Vdata+Vth stands. The first TFT T1 is turned on, and the OLED D1 emits light.

Further, it is known that the current flowing through the OLED D1 satisfies a formula as follows.

$$I_{D1}=K(V_{gs}-V_{th})^2 \quad (1)$$

$I_{D1}$ indicates the current flowing through the OLED D1; the constant K indicates an intrinsic conduction factor; $V_{gs}$ indicates a voltage difference between the gate of the first TFT T1 and the source of the first TFT T1.

$$Vgs=Vgn=Vg-Vn=V\text{data}+Vth \quad (2)$$

The equation (2) is substituted into the equation (1).

$$I_{D1}=K(V_{gs}-V_{th})^2$$

=K (Vdata+Vth−Vth)2

=K (Vdata)2

Therefore, the current $I_{D1}$ flowing through the OLED D1 is irrelevant to the threshold voltage $V_{th}$ imposed on the first TFT T1 while the current $I_{D1}$ is simply relevant to a data signal voltage $V_{data}$ so the threshold shift of the driven TFT is compensated, thereby solving the problem that the current flows through the LED may be unstable due to the threshold voltage shift of the driven TFT. Besides, the display brightness of the light emitting device is not affected by the ageing of the light emitting device itself, thereby making the display of the panel much more even.

In sum, by using the pixel driving circuit and the driving method for driving pixels of an AMOLED display, a 6T1C circuit is adopted by the pixel driving circuit and the pixel driving method proposed by the present disclosure so the threshold voltage of the driving tube is effectively compensated and that the current flowing through a light emitting device is not affected by the threshold voltage of the driving tube. The display brightness of the light emitting device is not affected by the ageing of the light emitting device itself, and the display of the panel becomes much more even; in other words, the display effect of the image improves. Besides, the structure of the light emitting device is simplified. In other words, the cost is obviously saved.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A pixel driving circuit, comprising:

a first thin-film transistor (TFT), comprising a gate electrically connected to a first node, a source electrically connected to a second node, and a drain electrically connected to a third node;

a second TFT, comprising a gate receiving the first scanning signal, a source grounded, and a drain electrically connected to a fourth node;

a third TFT, comprising a gate receiving a second scanning signal, a source electrically receiving a data signal, and a drain electrically connected to the second node;

a fourth TFT, comprising a gate receiving the first scanning signal, a source electrically connected to the third node, and a drain electrically connected to the first node;

a fifth TFT, comprising a gate receiving a third scanning signal, a source receiving a power positive voltage, and a drain electrically connected to the third node;

a sixth TFT, comprising a gate receiving a fourth scanning signal, a source electrically connected to the second node, and a drain electrically connected to the fourth node;

a capacitor, electrically connected between the first node and the fourth node;

an organic light-emitting diode (OLED), comprising an anode electrically connected to the fourth node and a cathode receiving a power negative voltage;

wherein the first scanning signal, the second scanning signal, the third scanning signal, and the fourth scanning signal are all provided by an external timing controller, and wherein the first scanning signal, the second scanning signal, the third scanning signal, and the fourth scanning signal are applied to a voltage-level initial phase, a voltage-level storage phase, and an illumination display phase.

2. The pixel driving circuit of claim 1, wherein the first TFT, the second TFT, the third TFT, the fourth TFT, the fifth TFT, and the sixth TFT are all low temperature poly-silicon (LTPS) TFTs, oxide semiconductor TFTs, or amorphous silicon (a-Si) TFTs.

3. The pixel driving circuit of claim 1, wherein the first TFT the second TFT, the third TFT, the fourth TFT, the fifth TFT, and the sixth TFT are all N-type TFTs;

at the voltage-level initial phase, the first scanning signal provides a high voltage level; the second scanning signal provides a high voltage level; the third scanning signal provides a high voltage level; the fourth scanning signal provides a low voltage level;

at the voltage-level storage phase, the first scanning signal provides a high voltage level; the second scanning signal provides a high voltage level; the third scanning signal provides a low voltage level; the fourth scanning signal provides a low voltage level;

at the illumination display phase, the first scanning signal provides a low voltage level; the second scanning signal provides a low voltage level; the third scanning signal provides a high voltage level; the fourth scanning signal provides a high voltage level.

4. A pixel driving circuit, comprising:

a first thin-film transistor (TFT), comprising a gate electrically connected to a first node, a source electrically connected to a second node, and a drain electrically connected to a third node;

a second TFT, comprising a gate receiving the first scanning signal, a source grounded, and a drain electrically connected to a fourth node;

a third TFT, comprising a gate receiving a second scanning signal, a source electrically receiving a data signal, and a drain electrically connected to the second node;

a fourth TFT, comprising a gate receiving the first scanning signal, a source electrically connected to the third node, and a drain electrically connected to the first node;

a fifth TFT, comprising a gate receiving a third scanning signal, a source receiving a power positive voltage, and a drain electrically connected to the third node;

a sixth TFT, comprising a gate receiving a fourth scanning signal, a source electrically connected to the second node, and a drain electrically connected to the fourth node;

a capacitor, electrically connected between the first node and the fourth node;

an organic light-emitting diode (OLED), comprising an anode electrically connected to the fourth node and a cathode receiving a power negative voltage.

5. The pixel driving circuit of claim 4, wherein the first TFT, the second TFT, the third TFT, the fourth TFT, the fifth TFT, and the sixth TFT are all low temperature poly-silicon (LTPS) TFTs, oxide semiconductor TFTs, or amorphous silicon (a-Si) TFTs.

6. The pixel driving circuit of claim 4, wherein the first scanning signal, the second scanning signal, the third scanning signal, and the fourth scanning signal are all provided by an external timing controller.

7. The pixel driving circuit of claim 4, wherein the first scanning signal, the second scanning signal, the third scanning signal, and the fourth scanning signal are applied to a voltage-level initial phase, a voltage-level storage phase, and an illumination display phase.

8. The pixel driving circuit of claim 7, wherein the first TFT, the second TFT, the third TFT, the fourth TFT, the fifth TFT, and the sixth TFT are all N-type TFTs;

at the voltage-level initial phase, the first scanning signal provides a high voltage level; the second scanning signal provides a high voltage level; the third scanning signal provides a high voltage level; the fourth scanning signal provides a low voltage level;

at the voltage-level storage phase, the first scanning signal provides a high voltage level; the second scanning signal provides a high voltage level; the third scanning signal provides a low voltage level; the fourth scanning signal provides a low voltage level;

at the illumination display phase, the first scanning signal provides a low voltage level; the second scanning signal provides a low voltage level; the third scanning signal provides a high voltage level; the fourth scanning signal provides a high voltage level.

9. A driving method for driving pixels, comprising:

step 1: providing a pixel driving circuit comprising:

a first thin-film transistor (TFT), comprising a gate electrically connected to a first node, a source electrically connected to a second node, and a drain electrically connected to a third node;

a second TFT, comprising a gate receiving the first scanning signal, a source grounded, and a drain electrically connected to a fourth node;

a third TFT, comprising a gate receiving a second scanning signal, a source electrically receiving a data signal, and a drain electrically connected to the second node;

a fourth TFT, comprising a gate receiving the first scanning signal, a source electrically connected to the third node, and a drain electrically connected to the first node;

a fifth TFT, comprising a gate receiving a third scanning signal, a source receiving a power positive voltage, and a drain electrically connected to the third node;

a sixth TFT, comprising a gate receiving a fourth scanning signal, a source electrically connected to the second node, and a drain electrically connected to the fourth node;

a capacitor, electrically connected between the first node and the fourth node;

an organic light-emitting diode (OLED), comprising an anode electrically connected to the fourth node and a cathode receiving a power negative voltage;

step 2: during a voltage-level initial phase, controlling a second thin-film transistor (TFT) and a fourth TFT to turn on with a first scanning signal; controlling a third TFT to turn off with a second scanning signal; controlling a fifth TFT to turn on with a third scanning signal; controlling a sixth TFT to turn off with a fourth scanning signal; writing a power positive voltage to a first node and storing the power positive voltage to a capacitor; writing a ground voltage to a fourth node to prevent an organic light-emitting diode (OLED) from emitting light;

step 3: during a voltage-level storage phase, controlling the second TFT and the fourth TFT to turn on with the first scanning signal; controlling the third TFT to turn on with the second scanning signal; controlling the fifth TFT to turn off with the third scanning signal; controlling the sixth TFT to turn off with the fourth scanning signal; providing a display data voltage level with a data signal; writing the display data voltage level to a second node; writing a ground voltage to the fourth node; keeping a voltage imposed on the first node the same as the sum of a voltage imposed on the second node and a threshold voltage of the first TFT with discharge of the capacitor, storing the voltage imposed on the first node to the capacitor to prevent the OLED from emitting the light; and step 4: during an illumination display phase, controlling the second TFT and the fourth TFT to turn off with the first scanning signal; controlling the third TFT to turn off with the second scanning signal; controlling the fifth TFT to turn on with the third scanning signal; controlling the sixth TFT to turn on with the fourth scanning signal; keeping the voltage imposed on the first node the same as the sum of the display data voltage level and the threshold voltage of the first TFT under the function of storage of the capacitor; making a voltage level of the second node consistent with a voltage level of the fourth node; turning the first TFT on; making the OLED emit light; making a current flowing through the OLED irrelevant to the threshold voltage imposed on the first TFT.

10. The driving method of claim 9, wherein the first TFT, the second TFT, the third TFT, the fourth TFT, the fifth TFT, and the sixth TFT are all low temperature poly-silicon (LTPS) TFTs, oxide semiconductor TFTs, or amorphous silicon (a-Si) TFTs.

11. The driving method of claim 9, wherein the first scanning signal, the second scanning signal, the third scanning signal, and the fourth scanning signal are all provided by an external timing controller.

12. The driving method of claim 9, wherein the first TFT, the second TFT, the third TFT, the fourth TFT, the fifth TFT, and the sixth TFT are all N-type TFTs;

at the voltage-level initial phase, the first scanning signal provides a high voltage level; the second scanning signal provides a high voltage level; the third scanning signal provides a high voltage level; the fourth scanning signal provides a low voltage level;

at the voltage-level storage phase, the first scanning signal provides a high voltage level; the second scanning signal provides a high voltage level; the third scanning signal provides a low voltage level; the fourth scanning signal provides a low voltage level;

at the illumination display phase, the first scanning signal provides a low voltage level; the second scanning signal provides a low voltage level; the third scanning signal provides a high voltage level; the fourth scanning signal provides a high voltage level.

* * * * *